US008995700B2

(12) United States Patent
Bothe

(10) Patent No.: US 8,995,700 B2
(45) Date of Patent: Mar. 31, 2015

(54) ACOUSTIC TRANSDUCER

(71) Applicant: d&b audiotechnik GmbH, Backnang (DE)

(72) Inventor: Frank Bothe, Backnang (DE)

(73) Assignee: d&b audiotechnik GmbH, Backnang (DE)

( * ) Notice: Subject to any disclaimer, the term of this patent is extended or adjusted under 35 U.S.C. 154(b) by 0 days.

(21) Appl. No.: 13/972,703

(22) Filed: Aug. 21, 2013

(65) Prior Publication Data

US 2014/0056458 A1 Feb. 27, 2014

(30) Foreign Application Priority Data

Aug. 21, 2012 (DE) ..... 10 2012 107 645

(51) Int. Cl.
*H04R 25/00* (2006.01)
*H04R 1/34* (2006.01)

(52) U.S. Cl.
CPC ..... *H04R 1/345* (2013.01)
USPC ..... 381/340; 381/337; 381/338; 381/339; 381/343

(58) Field of Classification Search
USPC ..... 381/337–343
See application file for complete search history.

(56) References Cited

U.S. PATENT DOCUMENTS

| | | | | |
|---|---|---|---|---|
| 1,546,537 | A | 7/1925 | Carl | |
| 4,860,367 | A | 8/1989 | Hook | |
| 6,581,719 | B2 * | 6/2003 | Adamson | 181/182 |
| 7,268,467 | B2 * | 9/2007 | De Vries | 381/340 |
| 7,275,621 | B1 * | 10/2007 | Delgado, Jr. | 381/340 |
| 7,631,724 | B2 * | 12/2009 | Onishi | 381/340 |
| 2004/0060768 | A1 | 4/2004 | Murphy | |

FOREIGN PATENT DOCUMENTS

| | | |
|---|---|---|
| EP | 0295614 | 12/1988 |
| EP | 2001261 | 12/2008 |
| EP | 1474951 | 7/2011 |
| GB | 355024 | 8/1931 |

OTHER PUBLICATIONS

Office Action cited in related DE application No. 10 2012 107 645.6 dated Jun. 21, 2013, pp. 10.

* cited by examiner

*Primary Examiner* — Suhan Ni
(74) *Attorney, Agent, or Firm* — Cooper Legal Group, LLC

(57) ABSTRACT

An acoustic transducer may comprise a sound source, a throat connected to the sound source, and a horn connected to the throat. The horn may be arranged on a wall, wherein the throat is designed such that a path of the sound from the sound source to an interface between the throat and the horn is shorter in a region close to the wall than at a region that is remote from the wall.

20 Claims, 3 Drawing Sheets

ACOUSTIC TRANSDUCER

RELATED APPLICATION

This application corresponds to German Patent Application 10 2012 107 645.6, filed on Aug. 21, 2012, at least some of which may be incorporated herein.

SUMMARY

The disclosed subject matter is related to an acoustic transducer and/or a method for using such an acoustic transducer.

Some acoustic transducers have a sound source, a throat connected to the sound source and a horn connected to the throat. In addition, acoustic transducers are known that can be mounted as a whole or with the horn on a wall, particularly in a tunnel. If such an acoustic transducer is mounted with a spacing from a wall (e.g., a sound-reflecting surface) a portion of the sound runs directly from the acoustic transducer to the wall and is reflected thereon. A person who is situated in proximity to the acoustic transducer may hear both the sound that comes directly from the acoustic transducer and the sound reflected on the wall. Since the directly arriving sound and the reflected sound have covered a different distance, a phase difference exists between these two sound waves at the location of the person. The phase difference brings about location-dependent destructive interference in the hearing plane of the person, which may result in an impairment in sound quality.

Destructive interference may be a problem in relatively low-ceilinged and acoustically hard environments, such as tunnels or multistory parking lots, in which the walls are made of concrete or hard coatings and are therefore good reflectors of sound.

DESCRIPTION OF THE DRAWINGS

Exemplary embodiments are explained below by way of example with reference to the drawings, in which.

DETAILED DESCRIPTION

Figure 1:
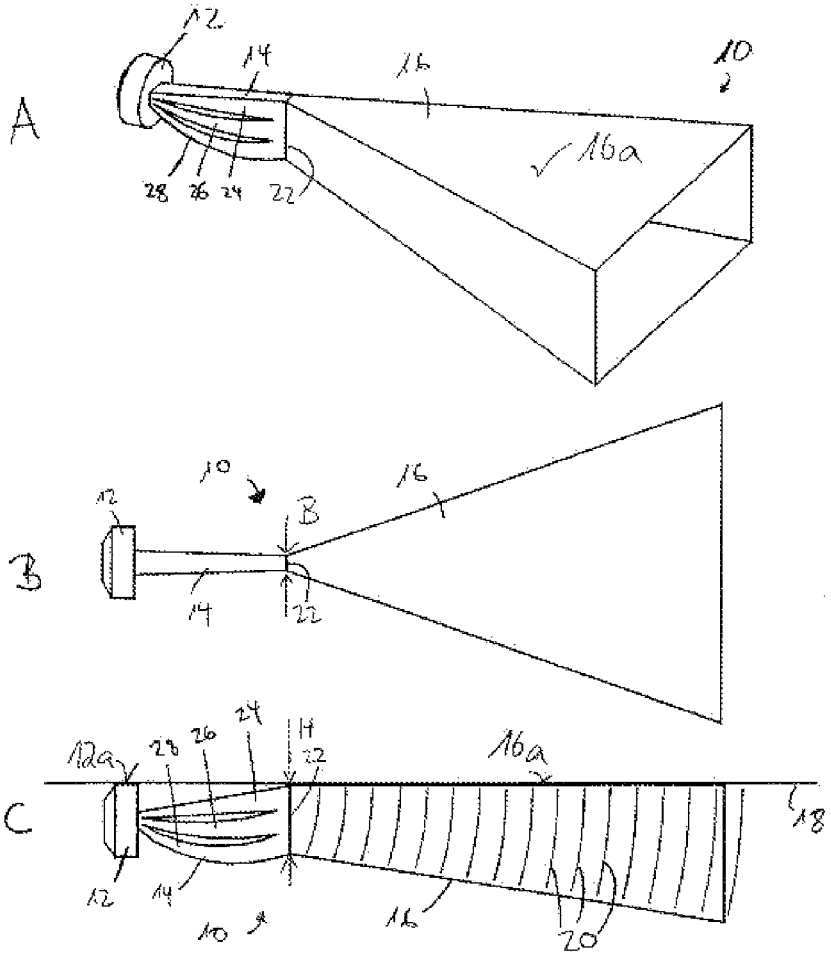
FIG. 1 illustrates various views of a first embodiment of an acoustic transducer.

In the following detailed description, direction terminology such as "top/above", "bottom/below", "vertical", "horizontal" and the like is used to explain the embodiments by way of example for an installation location, e.g. on a ceiling wall. Other orientations of the wall or of a lateral face of the throat or the horn associated with the wall are likewise possible. In addition, it is noted that the term "wall" or terms linked thereto such as "close to the wall", "remote from the wall", "parallel to the wall" or "away from the wall" and the like relate to an intended installation location for the acoustic transducer on a wall and are not intended to be understood to mean that a wall must actually already be present. A reference to the wall can thus be understood in a similar fashion as a reference to a lateral face of the throat or the horn which is associated with the wall. That is to say, by way of example, that "parallel to the wall" can also be understood in the sense of "parallel to that lateral face of the horn or throat that is associated with the wall".

An acoustic transducer may be provided that can be operated on or in proximity to an interface or wall without producing significant reflections on the interface.

Accordingly, the acoustic transducer may have a sound source, a throat connected to the sound source and a horn connected to the throat, wherein the horn can be arranged on a wall and the throat is designed such that a path for a sound from the sound source to the interface between the throat and the horn is shorter in a region close to the wall than in a region that is remote from the wall. An effect achieved by the different paths of the sound is that the sound wave at the interface in the region close to the wall has a different phase than the sound wave at the interface in a region that is remote from the wall. This brings about a rotation or deflection in the sound propagation direction away from the wall. In this context, wavefronts of the sound radiated by the sound source can intersect the interface between the throat and the horn such that a wavefront running already outside the throat in the vicinity of the wall is still situated inside the throat in the corresponding region that is remote from the wall.

On account of the path alteration in the direction of the normal to the wall, the aperture angle of the horn of the acoustic transducer, where the aperture angle is oriented parallel to the wall, may not be determined—or may be determined merely to a small extent—Hby the design of the sound guidance in the throat and can therefore be matched in greatly variable form to different installation conditions. In particular, horns with different aperture angles can be combined with a same unit comprising the sound source and the throat.

The interface between the throat and the horn may e.g. run essentially perpendicular to the wall surface.

In some embodiments, wavefronts of the sound are essentially perpendicular to the wall (or to a lateral face of the horn that is associated with the wall) in a region downstream of the interface between the throat and the horn. This may mitigate and/or avoid reflections on the wall.

The throat may have at least two physically separate channels that are paths of different length for the sound from the sound source to the interface between the throat and the horn. By way of example, the throat may have three or more physically separate channels. The physically separate channels may be connected to one another at the sound source and at the interface between the throat and the horn. The channels with paths of different length prompt a sound wave produced in the sound source to be split into a plurality of wave elements that, after passing through the physically separate channels, have different phases. Therefore, one or more sound waves obtained at the interface between the throat and the horn may have different phases. This may cause rotation or deflection of the propagation direction of the sound wave away from the wall.

In one embodiment, the throat is designed such that the path for the sound from the sound source to the interface between the throat and the horn increases from the wall in a direction away from the wall. This prompts a rotation or deflection of the propagation direction of the sound wave in a direction away from the wall. Following the rotation or deflection, the propagation direction of the sound may be oriented essentially parallel or in a direction slightly away from the wall. By way of example, the path from the vicinity of the wall in a direction away from the wall may increase steadily and/or evenly.

A further possible implementation is characterized in that the throat has two lateral faces that run essentially perpendicular to the wall and that have an increasing lateral curvature from a region close to the wall in a direction away from the wall. In this case, the curvature of the lateral faces is essentially perpendicular to the normal to the wall. The increasing curvature prompts the path of the sound, namely the distance from the exit from the sound source to the interface between the throat and the horn, to be shortest in the region close to the wall and to become (e.g., increasingly) longer in the direction away from the wall. By way of example, the lateral faces of the throat have no curvature (e.g., run rectilinearly) in the vicinity of the wall and have maximum curvature on the side of the throat that is remote from the wall.

The horn may have a rectangular cross section. The cross section of the horn may, for example, increase in the direction away from the throat in the sound propagation direction. This increase may be steady and, for example, linear or exponential.

In a plane running parallel to the wall, there may be an angle that is less than 180° between a center line of the throat and a center line of the horn.

By way of example, the angle may be of a magnitude such that the acoustic transducer may abut a planar area (e.g., a second wall) with a (second) lateral face of the horn and with the sound source.

The angle between the center line of the throat and the center line of the horn may be between 120° and 180° (e.g., between 150° and 170°).

The acoustic transducer may be designed to be arranged in an edge of two walls that run essentially perpendicular to one another, for example.

At least one acoustic transducer in accordance with the disclosure herein may be used on a wall, particularly a wall in an extensive low-ceilinged space such as a tunnel or a story on a parking level. This has the advantage that the wall does not produce any reflections of the sound wave and hence the sound quality within the extensive low-ceilinged space (e.g. tunnel) is improved. Provision may also be made for the acoustic transducer to be able to be arranged at an edge between two walls, particularly in a tunnel edge, as a result of which the acoustic transducer radiates therefrom without reflections on both walls.

According to an embodiment, at least two acoustic transducers are used that are operated according to the principle of synchronized longitudinal announcement (synchronized longitudinal announcement speaker system, SLASS). At least two loudspeakers that are arranged along a tunnel may be operated such that a sound wave that is emitted by a first loudspeaker, particularly along the tunnel, is synchronized to a sound wave that is emitted by a second loudspeaker, as a result of which no disturbing echoes arise in the tunnel, but rather the sound waves emitted by the at least two loudspeakers are superimposed with the same phase. In some embodiments, the loudspeakers emit the sound waves only in one direction, particularly along the tunnel. The effect achieved by the principle of synchronized longitudinal announcement is that, for example, announcements in a tunnel in which at least two such acoustic transducers are used are substantially improved, and in some environments even become possible for the first time.

FIG. 1 shows a first embodiment of an acoustic transducer 10.

The acoustic transducer 10 has a sound source 12, a throat 14 connected to the sound source 12 and a horn 16 connected to the throat 14. Electrical signals are converted in the sound source 12 into an acoustic wavefront that propagates into space surrounding the sound source 12.

The sound source 12 of the acoustic transducer 10 may have a compression driver, a cone loudspeaker or a loudspeaker of a different design, for example. By way of example, the sound source 12 may be an 80 watt compression driver. The sound source 12 may be a sound exit aperture with a diameter of 1 cm to 8 cm, for example, particularly approximately 3 cm to 5 cm, for example, which produces a circular shallow wavefront with a low amplitude and a relatively high pressure at the output of the compression driver.

The sound emitted by the sound source 12 and/or the tone or sound of said sound source may be a spoken message, a warning signal, music or any other audible signal, for example.

In general, the function of the throat 14 is to convert the wavefront coming from the sound source 12 into a shape that corresponds to or matches the shape of the horn 16.

FIG. 1 shows three different views of the same embodiment of an acoustic transducer 10. View A in FIG. 1 shows a schematic perspective illustration of this embodiment. View B in FIG. 1 shows a view from below, with the plane of the drawing corresponding to a plane that is parallel to the add-on plane (wall, in this case ceiling wall for example) (e.g., horizontal plane). View C in FIG. 1 shows a sectional illustration along a plane that runs perpendicular to the add-on plane (wall) (e.g., a vertical plane), which runs through the sound source 12, the throat 14 and the horn 16. In this sectional illustration, the add-on plane or interface is shown as wall 18, on which the acoustic transducer 10 with the horn 16 and the sound source 12 can be fitted or mounted. In addition, View C shows wavefronts 20 of the sound propagating in the horn 16 that occur inside the horn 16. In this case, three wavefronts are provided with the reference symbol 20 by way of example. The sound source 12, the throat 14 and the horn 16 are situated essentially in a plane that runs parallel to the wall 18, such as a plane that runs horizontally, for example.

View C illustrates that an upper lateral wall face 16A of the horn 16 and an upper boundary 12*a* of the sound source 12 may be situated in one plane and touch the wall 18 on which they are mounted, for example. At a junction between the throat 14 and the horn 16, there is an interface 22. View B illustrates that the arrangement of the sound source 12, the throat 14 and the horn 16 in the horizontal plane (e.g., the plane parallel to the wall) may be symmetrical. In this plane, the center line through the sound source 12 and the throat 14 may coincide with a center line through the horn 16. By way of example, the cross section of the horn 16 is rectangular (e.g., as illustrated in View A in FIG. 1) and can increase steadily, for example linearly or exponentially, in a direction away from the throat 14 in the sound propagation direction.

The horizontal aperture angle of the horn 16 can, but does not have to, correspond to the horizontal aperture angle of the throat 14. The throat 14 can open, run rectilinearly or, as can be seen in View B in FIG. 1, for example, else taper in the sound propagation direction. In the case of the acoustic transducer according to the description, the horizontal aperture angle of the horn 16 can be chosen largely independently of the horizontal aperture or taper angle of the throat 14 or the sound guidance of the sound from the sound source 12 to the interface 22 between the throat 14 and the horn 16. This can afford advantages particularly when certain horn geometries are prescribed, for example on the basis of physical circumstances.

In addition, View A in FIG. 1 and View C in FIG. 1 reveal that the throat 14 arranged between the sound source 12 and the horn 16 has a plurality of physically separate channels 24, 26 and 28. By way of example, more than one, two, three or four channels may be provided. The channels 24, 26, 28 are physically each separated from one another in a region between the sound source 12 and the horn 16. They merge at the sound source 12 in a central, relatively small region (e.g., close to the sound exit aperture of the sound source 12) and close to or at the interface 22 between the throat 14 and the horn 16 along the entire interface 22.

For the sound radiated by the sound source 12, the channels 24, 26, 28 are paths of different length from the sound source 12 to the interface 22 between the throat 14 and the horn 16. The sound wave that has travelled from the sound source 12 via the channel 24 to the interface 22 therefore has a different phase on the interface 22 than a sound wave that has travelled from the sound source 12 via the channel 26 or the channel 28 to the interface 22. Since the path of the channel 28 from the sound source 12 to the interface 22 is longer than that of the channel 26 and the latter is in turn longer than that of the channel 24, a plurality of (e.g., three) regions with different phases are obtained at the interface 22. Since the path of the channel 24 is shorter than the path of the channel 28, a wave element that starts from the sound source 12 and has travelled via the channel 24 to the interface 22 is already situated in the horn 16, while a wave element that has been emitted by the sound source 12 at the same time as the sound wave just mentioned and has travelled via the channel 28 may merely just have arrived at the interface 22 or is still in the channel 28 of the throat 14, for example.

This path alteration—enforced by the throat geometry—in a vertical direction across the throat cross section prompts a rotation or deflection of the propagation direction of the sound wave away from the wall 18. By way of example, the rotation or deflection can be adjusted such that the wavefronts of the sound are essentially perpendicular to the wall 18 in a region downstream of the interface 22 between the throat 14 and the horn 16, as a result of which few and/or no reflections take place on the wall 18 or inside the horn 16 on the lateral wall face 16*a*.

An advantage of the implementation can be seen in that despite a stipulated design for the sound guidance, such as the guidance of the sound wave from the sound source 12 via the throat 14 to the interface 22 between the throat 14 and the horn 16, it is possible to use different horns 16 with different horizontal aperture angles.

The overall arrangement of the acoustic transducer 10 may be approximately 0.8 m to approximately 1.20 m long, for example. The throat 14 may have a length of 10 to 30 cm, possibly approximately 20 cm, for example. The interface 22 between throat 14 and horn 16 may have a width B of approximately 2 cm (−1 cm, +3 cm), for example, in the horizontal and a height H of approximately 10 cm (±5 cm), for example, in the vertical. The height H of the interface 22 may be greater than the width B of the interface 22, for example. For some and/or all of the dimension statements specified above, different dimensions are also possible.

In the vertical (e.g., View C in FIG. 1), the aperture angle of the horn 16 may be approximately 10° to 20°, for example, particularly approximately 15°, for example. In the horizontal (e.g., View B in FIG. 1), the aperture angle of the horn 16 may be between 20° and 50°, for example, approximately 30°, for example. In this case too, aperture angles that differ from these statements are possible, for example the aperture angle of the horn 16 in the horizontal may also be about 100° and above.

Figure 2:
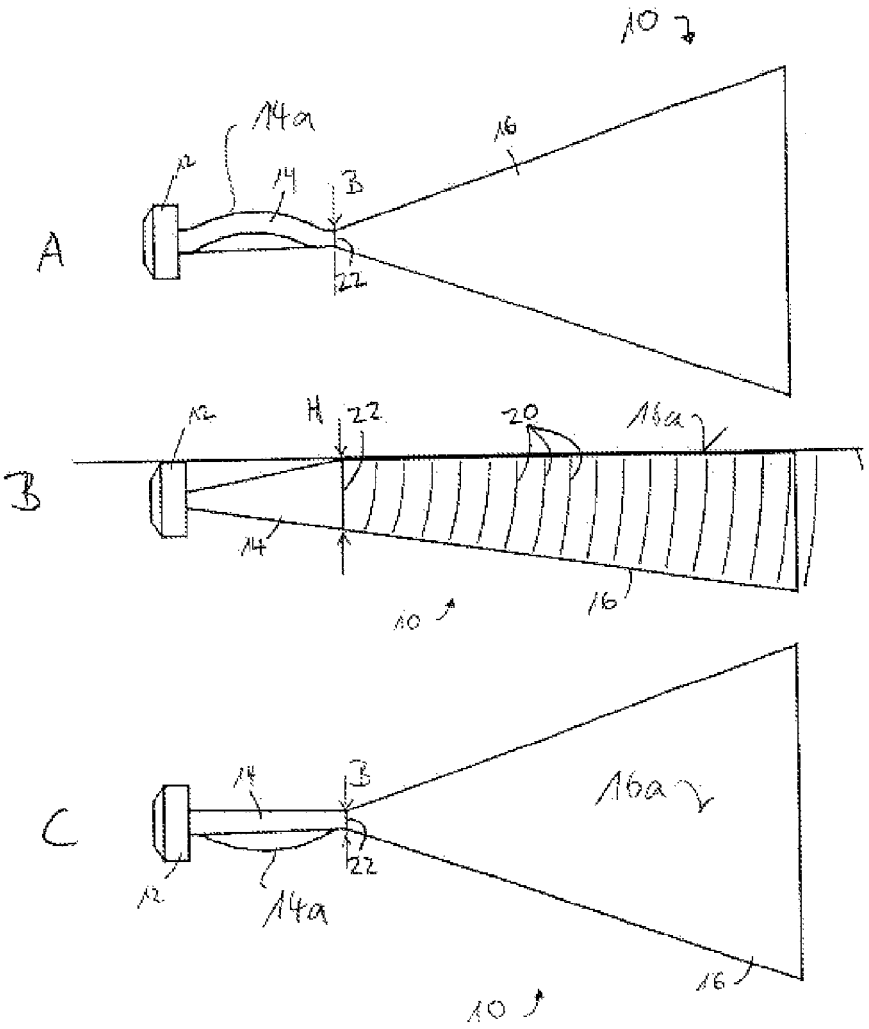
FIG. 2 illustrates various views of a second embodiment of an acoustic transducer.

FIG. 2 shows a second embodiment of an acoustic transducer 10 in various views. View A in FIG. 2 shows a view from below, such as on that side of the transducer 10 that is remote from the add-on plane (e.g., wall). View B in FIG. 2 shows a lateral sectional view. View C in FIG. 2 shows a view from above, such as on that side of the transducer 10 that faces the add-on plane (e.g., wall). As in the case of the first embodiment, in this case, too, the sound is produced in the sound source 12 and then travels via the throat 14 into the horn 16 so as then to leave the horn 16 at the end thereof.

By way of example, the second embodiment differs from the first embodiment (e.g., merely) in that the throat 14 has different shaping. The statements made in relation to the first embodiment, particularly with regard to dimensions and angle ranges, likewise apply to the second embodiment, for example.

View C in FIG. 2 reveals that the upper region, close to the wall, of the throat 14 may be slightly tapered, for example, from the sound source 12 to the interface 22 between the throat 14 and the horn 16, as in the case of the first embodiment, and is of rectilinear design, for example, such that there is no curvature in the horizontal lateral direction in relation to the sound propagation direction. View C and View A in FIG. 2 reveal that a lower region—that is remote from the wall—of the throat 14 may have a curvature 14*a* (or at least a more pronounced curvature than the upper region) in a horizontal, lateral direction in relation to the sound propagation direction, as a result of which a sound wave that passes through the throat 14 at a lower location—that is more remote from the wall—of the throat 14 covers a longer path than a sound wave that passes through the throat 14 at an upper location—that is closer to the wall—of the throat 14. In this case, both downwardly increasingly curved lateral walls of the throat 14 may have an outward curvature in the same lateral direction, as can be seen in View A in FIG. 1, in which the curved lateral walls of the throat 14 run essentially parallel, such that there is a wall spacing that is constant in terms of cross section, to one another. It is also possible for the throat 14 to have an outward curvature toward both sides, which is not shown, in which case the throat 14 is still undivided in the upper region close to the wall but then splits into two bypass channels with increasing wall curvature and path length as the spacing distance from the wall increases.

The wall-spacing-dependent path alteration in the throat 14, which is enforced by the shaping of the throat 14, prompts a rotation or deflection of the propagation direction of the sound wave away from the wall 18. The sound wave emerging from the throat 14 can therefore be reshaped, and particularly inclined away from the wall 18, in the same way as already described in relation to the first embodiment. The throat 14 in the second embodiment may comprise a single channel that is not divided into a plurality of separate channels, however.

It is pointed out that the measures for influencing the sound path through the throat 14 that are illustrated in the two embodiments can also be combined. That is to say that a throat 14 that is both multichannel and has an increasing outward curvature in one or both lateral directions laterally as the wall spacing increases, for example, may be provided. In this case, the channels 24, 26 and 28 in this order have an increasing lateral outward curvature.

As already mentioned, the embodiments described herein allow the use of different horns 16 with different horizontal aperture angles on one and the same sound guide (e.g., throat 14). It is also possible for the horn 16 already to be formed by inward shaping into the wall 18 as a depression, for example, and for just the sound source 12 and the throat 14 to have to be mounted on the wall in suitable fashion and to radiate into the wall depression (horn 16) that is already present.

Figure 3:
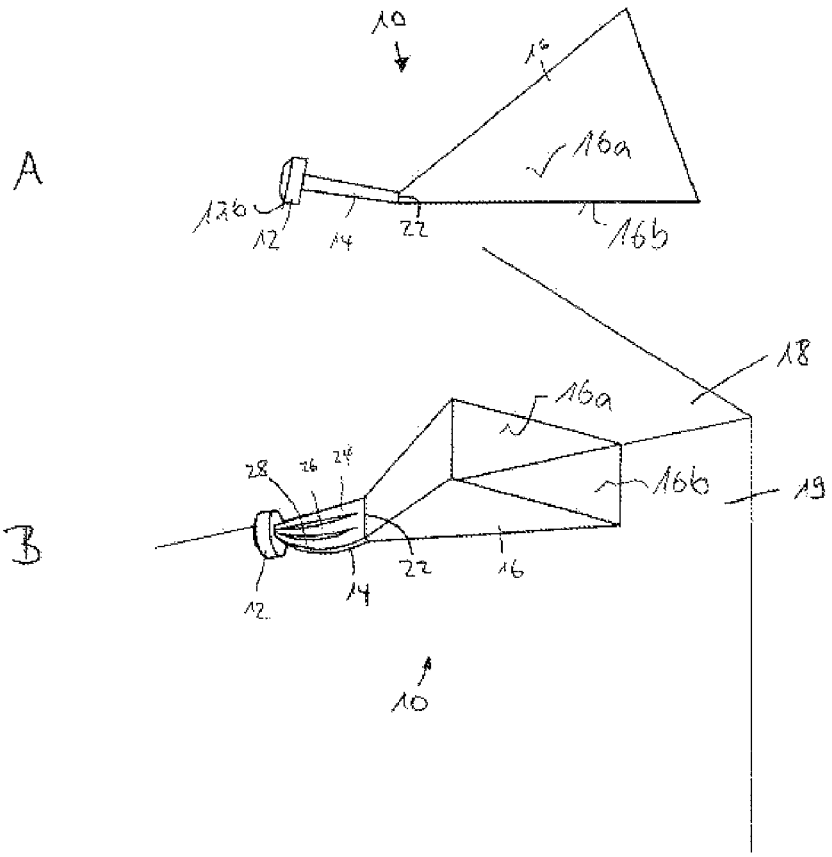
FIG. 3 illustrates an exemplary use of an acoustic transducer.

FIG. 3 shows a third embodiment of the acoustic transducer 10. In this case, View A in FIG. 3 shows this third embodiment from above in line with View C in FIG. 2, and View B in FIG. 3 shows the arrangement of this third embodiment of the acoustic transducer 10 in an edge between two wall sections that are perpendicular with respect to one another, for example in a tunnel wall edge or the like.

The third embodiment of the acoustic transducer 10 is shown using the example of the first embodiment, but may be implemented in similar fashion using the second embodiment or a combination of the first and second embodiments. In contrast to the embodiments described hitherto, the center line passing through the sound source 12 and the throat 14 is at an angle to the center line passing through the horn 16 in the horizontal plane. In this case, the angle is chosen such that the lateral wall 16*b* of the horn 16—which is depicted at the bottom in View A in FIG. 3—and a lower boundary 12*b* of the sound source 12 can be placed on a planar wall and mounted thereon. This angle between the center line of the throat 14 and the center line of the horn 16 may be between 120° and 180° (e.g., between 150° and 170°).

View B in FIG. 3 reveals how the third embodiment of the acoustic transducer 10 can have the lateral wall 16*b* of the horn 16 and the peripheral boundary 12*b* of the sound source 12 placed flat on a wall 19 and mounted thereon. In the case shown, the wall 19 runs vertically, for example. In addition, the acoustic transducer 10 has an upper lateral wall face 16*a* of the horn 16 and an upper region of the sound source 12 mounted on a wall 18 that runs horizontally, for example. The walls 18 and 19 may be perpendicular to one another and may be an edge in a low-ceilinged space, for example, such as a tunnel. Such an arrangement of the acoustic transducer 10 in such a wall edge may be advantageous because this arrangement is firstly space-saving and secondly does not bring about any reflections on the walls 18 and 19. The effect achieved by this arrangement in a lateral border region of a tunnel extent is likewise that sound reflection on opposite tunnel wall regions takes place (e.g., merely) at a (e.g., relatively) great distance from the transducer 10. This can be promoted (e.g., even further) by focusing the radiated sound in a relatively small spatial angle.

The influence of the angle that can be seen in View A in FIG. 3 between the horn 16 and the throat 14 on the transmission of the sound is dependent on the sound frequencies used. Frequencies having wavelengths greater than the smallest dimension used in the interface 22 between throat 14 and horn 16 are not influenced by the bend between horn 16 and the throat 14. At a value of 2 cm, these frequencies are lower than approximately 17000 Hz, which corresponds to a range that corresponds essentially to the hearing capability of human beings.

Although specific embodiments have been illustrated and described herein, it will be appreciated by those of ordinary skill in the art that a variety of alternate and/or equivalent implementations may be substituted for the specific embodiments shown and described without departing from the scope of the disclosed subject matter. This application is intended to cover any adaptations or variations of the specific embodiments discussed herein. Therefore, it is intended that the disclosed subject matter be limited merely by the claims and the equivalents thereof.

What is claimed is:

1. An acoustic transducer, comprising:

a sound source;

a throat connected to the sound source; and a horn connected to the throat, the horn configured to be arranged on or close to a wall, the throat designed such that a path for a sound from the sound source to an interface between the throat and the horn is shorter in a region close to the wall than at a region that is remote from the wall for rotating a sound propagation direction in a rotational direction away from the wall.

2. The acoustic transducer of claim 1, wherein wavefronts of the sound are essentially perpendicular to the wall in a region downstream of the interface between the throat and the horn, and wherein each wavefront of the sound is a surface of a sound wave having the same phase.

3. The acoustic transducer of claim 1, the throat comprising at least two physically separate channels that are paths of different length for the sound from the sound source to the interface between the throat and the horn.

4. The acoustic transducer of claim 1, the throat designed such that the path for the sound from the sound source to the interface between the throat and the horn increases from the region close to the wall in a direction away from the wall.

5. The acoustic transducer of claim 4, the throat comprising two lateral faces that run essentially perpendicular to the wall and that have an increasing lateral curvature from the region of the wall in a direction away from the wall.

6. The acoustic transducer of claim 5, the lateral curvature of the two lateral faces of the throat oriented in a same direction or oriented in opposite directions.

7. The acoustic transducer of claim 1, a width of the interface smaller than a height of the interface in a wall direction.

8. The acoustic transducer of claim 1, the horn comprising a rectangular cross section.

9. The acoustic transducer of claim 1, a cross section of the horn increasing in a direction away from the throat along the sound propagation direction.

10. The acoustic transducer of claim 1, an angle less than 180° comprised between a center line of the throat and a center line of the horn.

11. A method of emitting sound in a low-ceiling space, comprising:

providing an acoustic transducer comprising a sound source, a throat connected to the sound source and a horn connected to the throat, the horn comprising a face configured to be arranged on or close to a wall, the throat designed such that a path for the sound from the sound source to an interface between the throat and the horn is shorter in a region close to the wall than at a region that is remote from the wall for rotating a sound propagation direction in a rotational direction away from the wall; and mounting the acoustic transducer to the wall with the face of the horn facing the wall.

12. The method of claim 11, at least two acoustic transducers mounted to the wall, the at least two acoustic transducers operated according to a principle of synchronized longitudinal announcement.

13. An acoustic transducer, comprising:

a throat configured to be arranged close to a wall, the throat designed such that a path for a sound from a sound source to an interface between the throat and a horn is shorter in a region close to the wall than at a region that is remote from the wall for rotating a sound propagation direction in a rotational direction away from the wall.

14. The acoustic transducer of claim 13, comprising the horn.

15. The acoustic transducer of claim 13, comprising the sound source.

16. The acoustic transducer of claim 13, the throat designed such that the path for the sound from the sound source to the interface between the throat and the horn increases from the region close to the wall in a direction away from the wall.

17. The acoustic transducer of claim 16, the throat comprising two lateral faces that run substantially perpendicular to the wall and that have an increasing lateral curvature from the region close to the wall in a direction away from the wall.

18. The acoustic transducer of claim 17, the lateral curvature of the two lateral faces of the throat oriented in a same direction or oriented in opposite directions.

19. The acoustic transducer of claim 13, the horn connected to the throat.

20. The acoustic transducer of claim 13, the throat connected to the sound source.

* * * * *